US007387431B2

(12) United States Patent
Blakley

(10) Patent No.: US 7,387,431 B2
(45) Date of Patent: Jun. 17, 2008

(54) SANITARY STEADY BEARING AND METHOD

(75) Inventor: Robert A. Blakley, Rochester, NY (US)

(73) Assignee: SPX Corporation, Charlotte, NC (US)

( * ) Notice: Subject to any disclaimer, the term of this patent is extended or adjusted under 35 U.S.C. 154(b) by 386 days.

(21) Appl. No.: 11/090,006

(22) Filed: Mar. 28, 2005

(65) Prior Publication Data

US 2006/0215488 A1 Sep. 28, 2006

(51) Int. Cl.
*B01F 7/16* (2006.01)

(52) U.S. Cl. ..... 366/331; 384/132; 384/226

(58) Field of Classification Search ..... 366/331; 384/243, 244, 193, 226, 132; 277/602, 608, 277/628, 910, 208
See application file for complete search history.

(56) References Cited

U.S. PATENT DOCUMENTS 1,102,696 A * 7/1914 Shiner ..... 366/181.4
2,027,756 A * 1/1936 Tay ..... 366/195
3,327,953 A * 6/1967 Krumholz ..... 241/98
3,443,794 A * 5/1969 Peterson ..... 366/330.1
3,489,469 A * 1/1970 Stratienko ..... 384/134
5,568,976 A * 10/1996 Gabriele ..... 366/312
5,618,107 A * 4/1997 Bartsch ..... 366/279
6,386,753 B1 * 5/2002 Blakley ..... 366/331
2002/0176322 A1 * 11/2002 Kupidlowski ..... 366/330.3
2003/0142585 A1 * 7/2003 Blakley et al. ..... 366/331

* cited by examiner

*Primary Examiner*—David L Sorkin
(74) *Attorney, Agent, or Firm*—Baker & Hostetler LLP

(57) ABSTRACT

A sanitary steady bearing assembly and method provides for sanitary characteristics, easy cleanability, and easy replacement of wear parts without distributing the rest of the agitator, and can also support the agitator shaft during seal changes. The bearing assembly includes a bushing cup, a pedestal hub, a bushing shaft, and a bushing element.

22 Claims, 1 Drawing Sheet

SANITARY STEADY BEARING AND METHOD

FIELD OF THE INVENTION

The invention pertains to the field of bearings for a rotating shaft, and more particularly in some examples, pertains to steady bearings used to support an agitator shaft in a mixing vessel.

BACKGROUND OF THE INVENTION

Mixing devices are in wide use in industry. For example, a large number of applications in industries such as pharmaceuticals, food processing, chemical processing, and other industries often use a mixing device which includes a vessel for containing the material to be mixed, and a typically vertical agitator shaft that is driven by a motor and has radially extending impellers.

In some of these arrangements, the vertical agitator shaft is a multi-piece shaft having a top shaft driven by a motor and gearbox or speed reducer, connected to one or more intermediate impeller shafts with radial impellers, and a lower or bottom shaft. Often, the vertical agitator shaft projects downwards from the top of the vessel and at its lower end is supported by a so-called steady bearing or foot bearing. The foot bearing typically includes some form of bushing arrangement that is attached to the lower end of the shaft to resist side loads on the shaft.

The above mentioned conventional foot-type steady bearing designs are effective, but have some disadvantages however. In particular, some industries require highly sanitary operating conditions and cleanability. The presently known steady foot bearing designs suffer from the disadvantages that they typically have numerous horizontal surfaces, unsealed cavities, exposed threaded connections, and other difficult to clean surfaces and components.

Another difficultly with the present designs is that replacement of the bushing wear parts can generally not be accomplished without significant vertical adjustment of the agitator shaft, thus undesirably requiring partial disassembly of the rest of the mixer, including the top seal.

Yet another disadvantage of the existing designs is that during repair or maintenance of the top seal arrangement, these designs may not have the ability to support the bottom of the agitator shaft, and therefore support of the agitator shaft is required from the top during these changes.

Accordingly, there is a need in the art for an improved sanitary steady bearing and method which provides for sanitary characteristics, easy cleanability, and easy replacement of wear parts without disassembling the rest of the agitator, and which can also support the agitator shaft during seal changes.

SUMMARY OF THE INVENTION

The foregoing needs are met, to a great extent, by the present invention, wherein in one aspect an apparatus and method is provided that in some embodiments provides for sanitary characteristics, easy cleanability, and easy replacement of wear parts without disassembling the rest of the agitator, and which can also support the agitator shaft during seal changes.

In accordance with one aspect, the present invention provides a bearing apparatus for supporting a lower rotating agitator shaft with respect to a stationary lower surface of a vessel is provided, the bearing assembly comprising a cylindrical bushing cup mounted to and projecting downwardly from the lower agitator shaft; a pedestal hub mounted to the vessel by a plurality of legs attached to the vessel; an upwardly projecting bushing shaft mounted to the pedestal hub; and a bushing element mounted to the inside of the bushing cup and surrounding the bushing shaft for rotational sliding contact with the outside of the bushing shaft.

In accordance with another aspect of the present invention, a bearing apparatus for supporting a lower rotating agitator shaft with respect to a stationary lower surface of a vessel is provided, the bearing assembly comprising a cylindrical bushing cup projecting downwardly from the lower agitator shaft; supporting means mounted to the vessel by a plurality of legs attached to the vessel; an upwardly projecting bushing shaft mounted to the supporting means; and a bushing element mounted to the inside of the bushing cup and surrounding the bushing shaft for rotational sliding contact with the outside of the bushing shaft.

In accordance with yet another aspect of the present invention, a method for supporting a lower rotating agitator shaft with respect to a stationary lower surface of a vessel is provided, the bearing assembly comprising mounting a cylindrical bushing cup to project downwardly from the lower agitator shaft; mounting an upwardly projecting bushing shaft to a pedestal hub mounted to the vessel by a plurality of legs attached to the vessel; and mounting a bushing element inside of the bushing cup and surrounding the bushing shaft for rotational sliding contact with the outside of the bushing shaft.

There has thus been outlined, rather broadly, certain embodiments of the invention in order that the detailed description thereof herein may be better understood, and in order that the present contribution to the art may be better appreciated. There are, of course, additional embodiments of the invention that will be described below and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of embodiments in addition to those described and of being practiced and carried out in various ways. Also, it is to be understood that the phraseology and terminology employed herein, as well as the abstract, are for the purpose of description and should not be regarded as limiting.

As such, those skilled in the art will appreciate that the conception upon which this disclosure is based may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

DETAILED DESCRIPTION

Some embodiments of the invention provide for an improved sanitary steady bearing and method which provides for sanitary characteristics, easy cleanability, and easy replacement of wear parts without distributing the rest of the agitator, and which can also support the agitator shaft during seal changes.

Figure 1:
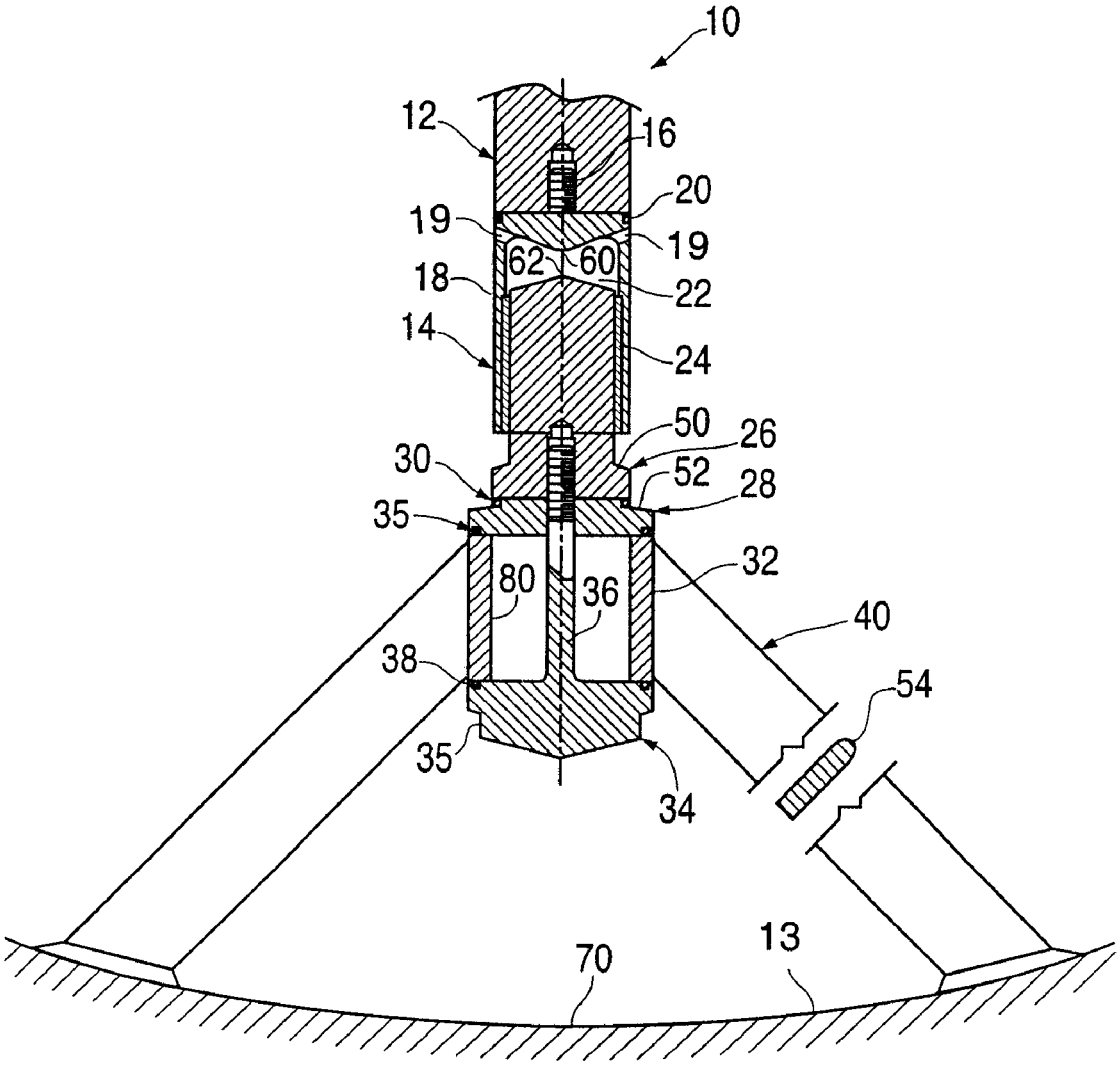
FIG. 1 is a cross-sectional view of a steady bearing assembly according to a preferred embodiment of the invention.

The invention will now be described with particular reference to the drawing figures, in which like reference numerals denote like parts throughout. FIG. 1 is a cross-sectional view of a steady bearing assembly 10 providing support for a lower agitator shaft 12 with respect to a lower interior surface of a mixing vessel 13. The lower agitator shaft 12 is a lower part or piece of a single or multi-part agitator shaft that is supported from a bearing and seal assembly located at the top of the mixing vessel and is rotatably driven by a motor. The lower end of the lower agitator shaft 12 is connected to a bushing cup 14 by virtue of threaded engagement of a threaded projection 16 of the bushing cup 18 into a suitable threaded bore disposed at the bottom end of the lower agitator shaft 12.

The bushing cup 14 projects downward in a generally hollow cylindrical manner and has one or several vent holes 19 therethrough, which are circumferentially spaced. In one preferred embodiment, two vent holes 19 are provided, spaced 180 degrees apart. The joint between the lower agitator shaft 12 and the bushing cup 14 is preferably sealed by a circumferential O-ring 20, which follows ASME-BPE in that the groove for the O-ring 20 is dimensioned to be 90 percent of the cross-sectional area of the uncompressed O-ring 20 itself providing for the O-ring to fully fill the groove, and further providing for cleanability. The vent holes 19 in the bearing cup 14 particularly during rotation of the shaft 12 provide for some movement of the material in the vessel to flow through the open area 22 formed inside the bearing cup 14. A significant function of the vent holes 19 is that when a cleaning solution is present in the vessel, the vent holes 19 allow for cleaning solutions to clean this internal portion of the bearing assembly.

A bushing element 24 is press fit into the bearing cup 14 and rotates together with the bearing cup 14 and the lower agitator shaft 12. The inner surface of the bushing element 24 is in rotational sliding contact with the outer surface of a bearing shaft 26. Thus, it can be appreciated that cleaning solution that flows into the vent holes 19 have the possibility of working into any small gaps between the bushing element 24 and the bushing shaft 26 to thereby clean that surface. The inner diameter of the bushing element 24 is selected to be just slightly greater than the outer diameter of the corresponding portion of the bushing shaft 26 so that the bushing element 24 contacts and rubs against the bushing shaft 26, in order to resist side loads provided by the lower agitator shaft 12, thus keeping the lower agitator shaft 12 radially in position during operation.

The bearing shaft 26 is supported against a top support plate 28 as shown. A plurality of male/female engagement rabbets, can be provided to lock the bushing shaft to the stationary top support plate so that the bushing shaft 26 is not able to rotate with respect thereto. An O-ring 30 may be provided to seal the joint between the bushing shaft 26 and the top support plate 28 in a fashion similar to the O-ring 20 described above.

The top support plate 28 rests on a pedestal hub 32, and at the outer joint connection of these two parts an O-ring 35 will be provided, also similar to the O-rings 30 and 20. A bottom cap 34 has a threaded projection 36 and engages a threaded receptacle in the bushing shaft 26 and when tightened, pulls the bushing shaft 26 and top plate 28 in a downward compression against the pedestal hub 32. The mating surface between the bottom cap 34 and the pedestal hub 32 are sealed by another O-ring 38 similar to O-rings 20, 30 and 35. Thus, it can be appreciated that by tightening the bottom cap 34, the above described assembly adopts a fixed rigid configuration to support the rotating bushing element 24, bushing cap 14, and lower rotating agitator 12. The pedestal hub 32 is supported by a plurality of preferably evenly radially located legs 40 forming an overall stool assembly. In one preferred embodiment, four legs 40 are provided, spaced 90 degrees apart. The legs 40 are welded at their lower ends to the vessel 14.

One advantage of the preferred embodiment is that it does not provide upwardly facing flat horizontal surfaces on which material would collect. For example, the lower agitator shaft 12 and bushing cup 14 are of the same diameter so that they do not present a horizontal surface. The vent holes 19 are downwardly sloping and this also does not present a horizontal surface. The top shoulder 50 of the bushing shaft 26 is downwardly and outwardly sloping and the top shoulder 52 of the top support plate 28 is similarly downwardly and outwardly sloping. The legs 40 preferably have a rounded top surface 54. These are the only upwardly facing surfaces presented by the above described arrangement, and this provides the benefit that neither particulates nor evaporating fluid leave a residue behind to the degree that would occur with a flat surface. Further, the four O-rings 20, 30, 35 and 38 provide sealing at each of the joints between the components used in the assembly 10. The sloped shoulder surfaces 50 and 52 described above may be at any suitable angle, but preferably may be sloped 5 to 15 degrees off of horizontal, thus providing for liquid runoff and preventing standing pools or collection of particulates.

The bottom cap plate 34 preferably has a gripping surface such as for example a plurality of four flats 37 that can be engaged by a simple wrench having for example a square internal opening to facilitate tightening the bottom cap 34.

Some embodiments of the invention can be particularly suitable for highly sterile applications. In such instances, the external surfaces may be polished as required by the application, such as for example polishing to 25 Ra, or being electro-polished to further enhance the finish and sanitary nature of the device. Further, it is noted that the external portions of the assembly do not have any cavities or other irregular internal (areas other than the area 32 which is flushable via the vent holes 19).

Another feature of the illustrated preferred embodiment is that a vertical gap is present between the lower tip 60 of the bushing cup 14 and an upper tip 62 of the bushing shaft 26. In some embodiments this gap may be approximately 1 inch. This separation or gap accommodates the fact that the vessel will typically grow and contract as it experiences differing pressures and temperatures between the ambient, operating and cleaning modes. That is, the gap permits the bushing cup 14 to move vertically axially relative to the bushing shaft 26 to account for these different conditions. The lower agitator shaft 12 is typically the lowest piece of a multi-piece elongated shaft. A further benefit of this arrangement is that if a seal change is required at the top of the vessel, the agitator shaft 12 can be lowered until tip 60 contacts tip 62, at which point the agitator shaft 12 is both vertically and axially supported at its lower end, and the upper parts of the shaft assembly can be separated in the machine so that the shaft seal at the top of the vessel can be replaced.

Another benefit of the illustrated preferred embodiment is that the top support plate 28, the pedestal hub 32 and the bottom cap 34 are located in a raised position and are above the bottom surface of the vessel 14. These elements are supported by the radially extending legs 40. A benefit of this design is that the center most region 70 of the vessel is kept free and clear from interference or blockage. This provides the advantage that a drain connection can be provided at the bottom region 70 of the vessel. This is also desirable because it permits the installation of other drain elements such as a flush bottom valve if desired. This also provides a benefit over at least some prior art lower foot steady bearing designs which use a circumferential flange that blocks access to the center bottom inner surface 70.

Yet another benefit of the illustrated preferred embodiment is that it is easy to disassemble. For example, one method of disassembly of the steady bearing assembly 10 for example, for maintenance, includes using a strap wrench or a custom fit square wrench to unscrew the cap 34 so as not to damage the polished surfaces. This loosens the bushing shaft 26 from the top support plate 28 so that when the lower agitator shaft 12 is manually raised (for example for about 0.50 inches) the serrations or rabbits will disengage allowing the top support plate 28 to be slid out laterally once the bottom cap 34 has been removed out the bottom. The outer diameter of the bushing shaft 26 is smaller than the bore 80 inside the pedestal hub 32 and so the bushing shaft 26 can be lowered through the bore 80 and removed out the bottom. Using a suitable tool such as a strap wrench, the bushing cup 14 can be unscrewed from the bottom of the agitator shaft 12 and either passed through the bore 80 in the pedestal hub 32 or removed laterally. A convenient benefit is that the pedestal hub 32 and support legs 40 are not disturbed during this process, which saves time and also eliminates the need to realign the pedestal hub 32 during assembly, since the pedestal hub remains in position even when the other components are disassembled.

The two threaded connections can preferably be directioned (e.g. right handed for clockwise rotation) to provide for constant tightening during the normal mixing rotation operation.

Figure 2:
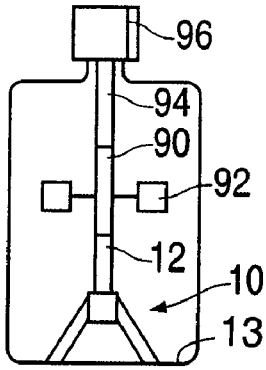
FIG. 2 is a schematic view of a mixing device incorporating the steady bearing shown in FIG. 1.

FIG. 2 is a schematic view of the mixer showing a lower agitator shaft 12 being supported by the steady bearing arrangement 10 shown in FIG. 1. The lower agitator shaft 12 is connected to a middle agitator shaft 90 which has a plurality of radially extending impellers projecting there from, and which is driven by a top shaft 94 that is attached to a motor driven gear box and seal assembly 96 at the top.

The many features and advantages of the invention are apparent from the detailed specification, and thus, it is intended by the appended claims to cover all such features and advantages of the invention which fall within the true spirit and scope of the invention. Further, since numerous modifications and variations will readily occur to those skilled in the art, it is not desired to limit the invention to the exact construction and operation illustrated and described, and accordingly, all suitable modifications and equivalents may be resorted to, falling within the scope of the invention.

What is claimed is:

1. An apparatus having a vessel and a bearing apparatus for supporting a lower end of a rotating agitator shaft with respect to a stationary lower surface of the vessel, the apparatus comprising:

a bushing cup having a cylindrical inner surface, and mounted to and projecting downwardly from the lower end of the agitator shaft;

a pedestal hub mounted to the vessel by a plurality of legs attached to the vessel;

an upwardly projecting bushing shaft having a cylindrical outer surface, and mounted to the pedestal hub;

a cylindrical bushing element mounted to the inside of the bushing cup and surrounding the bushing shaft for rotational sliding contact with the cylindrical outer surface of the bushing shaft wherein the cylindrical bushing cup and the cylindrical outer surface of the bushing shaft overlap axially so that axial movement is accommodated and rotational sliding contact of the bushing element with the cylindrical outer surface of the bushing shaft is maintained during a range of axial movement between the cylindrical bushing cup and the cylindrical bushing shaft; and a top support plate disposed between the bushing shaft and the pedestal hub.

2. The apparatus of claim 1, wherein the bushing shaft is disposed to project upward above the pedestal hub, and further wherein the apparatus further comprises a bottom cap plate disposed partially below the pedestal hub and having threaded engagement with the bushing shaft to fix the bushing shaft with respect to the pedestal hub.

3. The apparatus according to claim 1, wherein the legs each have a rounded upwardly facing surface.

4. The apparatus according to claim 1, wherein the bushing shaft has an angled upwardly facing shoulder.

5. The apparatus according to claim 1, wherein the cylindrical portion of the bushing cup includes a at least one vent hole projecting through the bushing cup at an axial location above the bushing element.

6. The apparatus of claim 1, further comprising an O-ring seal disposed between the bushing cup and the agitator shaft.

7. The apparatus of claim 1, further comprising an O-ring seal between the bushing shaft and the top support plate.

8. The apparatus according to claim 1, wherein the top support plate has a downwardly sloping upwardly facing shoulder.

9. The apparatus according to claim 1, further comprising an O-ring disposed between the top support plate and the pedestal hub.

10. The apparatus according to claim 1, further comprising an O-ring disposed between the bottom cap plate and the pedestal hub.

11. An apparatus having a vessel and a bearing apparatus for supporting a lower end of a rotating agitator shaft with respect to a stationary lower surface of the vessel, the apparatus comprising:

a bushing cup having a cylindrical inner surface, and mounted to and projecting downwardly from the lower end of the agitator shaft;

supporting means mounted to the vessel by a plurality of legs attached to the vessel;

an upwardly projecting bushing shaft having a cylindrical outer surface, and mounted to the supporting means;

a cylindrical bushing element mounted to the inside of the bushing cup and surrounding the bushing shaft for rotational sliding contact with the cylindrical outer surface of the bushing shaft, wherein the cylindrical bushing cup and the cylindrical outer surface of the bushing shaft overlap axially so that axial movement is accommodated and rotational sliding contact of the bushing element with the cylindrical outer surface of the bushing shaft is maintained during a range of axial movement between the cylindrical bushing cup and the cylindrical bushing shaft; and a top support plate disposed between the bushing shaft and the supporting means.

12. The apparatus of claim 11, wherein the bushing shaft is disposed to project upward above the supporting means, and further wherein the apparatus further comprises a bottom cap plate disposed partially below the supporting means and having threaded engagement with the bushing shaft to fix the bushing shaft with respect to the supporting means.

13. The apparatus according to claim 11, wherein the legs each have a rounded upwardly facing surface.

14. The apparatus according to claim 11, wherein the bushing shaft has an angled upwardly facing shoulder.

15. The apparatus according to claim 11, wherein the cylindrical portion of the bushing cup includes a at least one vent hole projecting through the bushing cup at an axial location above the bushing element.

16. The apparatus of claim 11, further comprising an O-ring seal disposed between the bushing cup and the agitator shaft.

17. The apparatus of claim 11, further comprising an O-ring seal between the bushing shaft and the top support plate.

18. The apparatus according to claim 11, wherein the top support plate has a downwardly slopping upwardly facing shoulder.

19. The apparatus according to claim 11, further comprising an O-ring disposed between the top support plate and the supporting means.

20. The apparatus according to claim 11, further comprising an O-ring disposed between the bottom cap plate and the supporting means.

21. A method for supporting a lower end of a rotating agitator shaft with respect to a stationary lower surface of a vessel, the method comprising:

mounting a bushing cup having a cylindrical inner surface so that the cup projects downwardly from the lower end of the agitator shaft;

mounting an upwardly projecting bushing shaft having a cylindrical outer surface to a pedestal hub mounted to the vessel by a plurality of legs attached to the vessel;

mounting a cylindrical bushing element inside of the bushing cup and surrounding the bushing shaft for rotational sliding contact with the outside of the bushing shaft, wherein the cylindrical bushing cup and the cylindrical outer surface of the bushing shaft overlap axially so that axial movement is accommodated and rotational sliding contact of the bushing element with the cylindrical outer surface of the bushing shaft is maintained during a range of axial movement between the cylindrical bushing cup and the cylindrical bushing shaft; and a top support plate disposed between the bushing shaft and the pedestal hub.

22. A mixer comprising:

a vessel;

a rotating agitator shaft having a lower end; and a bearing apparatus for supporting the lower rotating end of the agitator shaft with respect to a stationary lower surface of the vessel, the bearing apparatus comprising:

a bushing cup having a cylindrical inner surface, mounted to and projecting downwardly from the lower agitator shaft;

a pedestal hub mounted to the vessel by a plurality of legs attached to the vessel;

an upwardly projecting bushing shaft having a cylindrical outer surface, and mounted to the pedestal hub;

a cylindrical bushing element mounted to the inside of the bushing cup and surrounding the bushing shaft for rotational sliding contact with the outside of the bushing shaft wherein the cylindrical bushing cup and the cylindrical outer surface of the bushing shaft overlap axially so that axial movement is accommodated and rotational sliding contact of the bushing element with the cylindrical outer surface of the bushing shaft is maintained during a range of axial movement between the cylindrical bushing cup and the cylindrical bushing shaft; and a top support plate disposed between the bushing shaft and the pedestal hub.

* * * * *